United States Patent [19]

Copeland

[11] Patent Number: 4,697,950

[45] Date of Patent: Oct. 6, 1987

[54] ILLUMINATED STEPPING PAD

[76] Inventor: Wayne E. Copeland, 2641 Townsgate Rd., Suite 600, Westlake Village, Calif. 91361

[21] Appl. No.: 871,083

[22] Filed: Jun. 5, 1986

[51] Int. Cl.[4] ..... E01F 9/04

[52] U.S. Cl. ..... 404/9; 116/63 R; 340/117

[58] Field of Search ..... 404/6, 9, 11, 12, 15, 404/22, 23; 116/63 R, 63 P; 340/116, 117

[56] References Cited

U.S. PATENT DOCUMENTS 640,140 12/1899 Lloyd ..... 340/117

FOREIGN PATENT DOCUMENTS 2527754 1/1977 Fed. Rep. of Germany ..... 404/15

2393109 2/1979 France ..... 404/12

396461 8/1933 United Kingdom ..... 404/11

*Primary Examiner*—Stephen J. Novosad

*Assistant Examiner*—John F. Letchford

*Attorney, Agent, or Firm*—Roger A. Marrs

[57] ABSTRACT

An illuminated stepping pad is disclosed herein intended to be buried in the ground having a circular base including an upright continuous sidewall terminating in a circular knurled lip. A light is operably carried on said base between a plurality of columns constituting load-bearing standoffs. A lid displaying messages, ornamental graphics or the like is removably carried on the base about the lip and may include an irregular exterior surface of non-skid composition. The lid is composed of translucent material allowing diffusion of the light. Anchor devices may be employed to engage with the ground to prevent undesired movement or rotation of the base.

1 Claim, 9 Drawing Figures

ILLUMINATED STEPPING PAD

BACKGROUND OF THE INVENTION

1. Field of the Invention

The present invention relates to the field of display devices and, more particularly, to a novel stepping stone or pad device that may be readily illuminated to display message material, indicia or graphic characters while the device is embedded in the ground.

2. Brief Description of the Prior Art

In the past, it has been the conventional practice to mark a pathway by employing solid stepping stones or rounds of wood that are arranged in fixed spaced apart relationship so that a person can conveniently walk from one place to another along the pathway by stepping alternately on the respective stepping stones. Problems have been encountered when employing such conventional markers since they may crack, chip or, in the case of wood, become rotten and considerably checked. Also, it is not possible to conveniently carry messages for advertising purposes or other indicia identifying the stepping stone or a group of such stones.

Although some attempts may have been made to indirectly illuminate markers buried in the ground, such attempts are not feasible since extensive lighting systems are required and the lighting is not carried directly by the stepping stone or pad itself. Also, the pad must be of rigid construction so as to prevent cracking and breaking upon the load bearing applications when a person steps thereon. Also, means should be provided so that the pad or stone does not move or become displaced after considerable usage of the pad for stepping and pathway marking purposes.

Therefore, a long standing need has existed to provide a novel simulated stepping stone or pad which will readily carry message or indicia information capable of being illuminated by applying low voltage power and which will not readily be displaced or damaged after continuous usage.

SUMMARY OF THE INVENTION

Accordingly, the above problems and difficulties are obviated by the present invention which provides a novel simulated stepping stone or pad which includes a base means having a flat, circular panel supporting a continuous upright sidewall which terminates in a knurled lip detachably connecting with a downwardly depending knurled flange carried on a lid or cover. The base means further includes an illumination means employing low voltage that is strategically located on the base means panel for disseminating light throughout a central cavity established between the opposing surfaces of the lid and the base means panel and the continuous sidewall supporting the lid. Preferably, the lid is composed of translucent or transparent material that will carry light rays therethrough and, in some instances, diffuse the light for decorative purposes. The lid may be provided with a smooth exterior surface or may be provided with an irregular surface of non-skid material and the lid may also carry ornamental indicia, graphic characters or message indicia. Anchor means are carried on the underside of the panel engageable with the ground to prevent movement or rotation of the device when in use. Load bearing means are critically located between the opposing surfaces of the base means panel and the lid so as to transfer loads from the lid through the panel to the supporting ground.

Therefore, it is among the primary objects of the present invention to provide a novel simulated stepping stone or foot pad whereby internal illuminating means is employed to light the simulated stone or pad whereby the pathway is readily marked for the user.

Another object of the present invention is to provide a novel simulated stepping stone or foot pad which displays message indicia or other graphic characters which, when illuminated, attracts the attention of the user to the pathway and marks the area intended to be stepped on.

Still another object of the present invention is to provide a novel simulated stepping stone or foot pad which includes load bearing means for transferring applied loads directly to the ground in which the device is buried and which will withstand substantial loading without causing damage, cracking or the like.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1A:
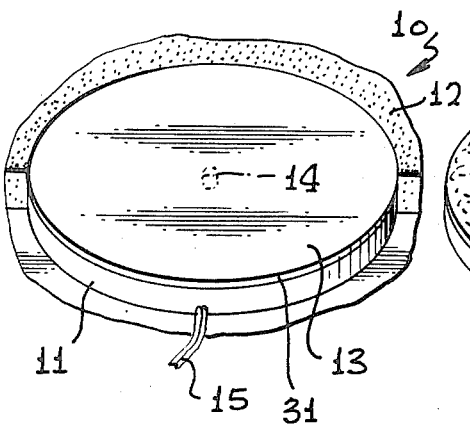
FIG. 1A is a front perspective view of the novel simulated stepping stone and foot pad of the present invention.
Figure 1B:
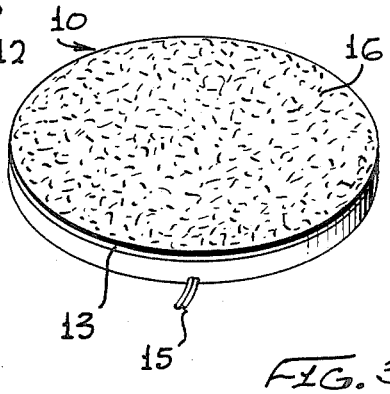
FIG. 1B is a view similar to the view shown in FIG. 1A wherein the device includes a non-skid exterior surface.
Figure 1C:
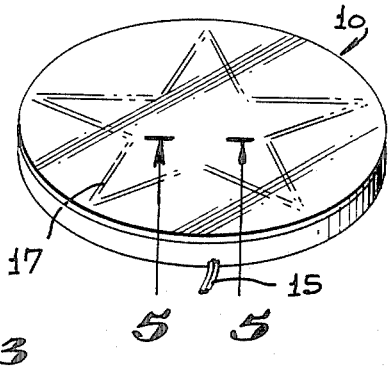
FIG. 1C is a view similar to the view of FIGS. 1A and 1B illustrating graphic subject matter carried thereon.

Referring to FIG. 1A, the novel simulated stepping stone or foot pad is shown in the general direction of arrow 10 which includes a base means 11 buried in the surface of ground 12 so that the exterior surface of a lid 13 is exposed. Preferably, the lid 13 is composed of a translucent material so that light rays from a bulb 14 will illuminate the lid. The bulb 14 is connected to a low voltage source via electrical leads 15. In FIG. 1B, the external surface of the lid 13 is provided with an irregular or rough surface indicated by numeral 16 which may take the form of a suitable non-skid material. The surface may be readily molded to achieve the irregularity or a variety of compounds, such as sand, may be adhered to the surface by adhesive or other means. In FIG. lC, the lid 13 is provided with graphic subject matter such as the star configuration 17. It is to be understood that other indicia or messages may be placed so that, when illuminated, the message or graphic subject matter becomes more readily visible.

Figure 2:
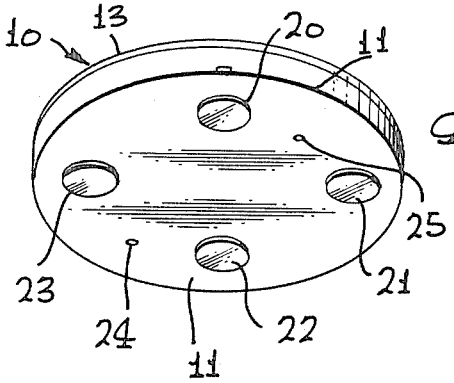
FIG. 2 is a perspective view of the underside of the novel stepping stone or foot pad shown in FIG. 1A.

Referring now in detail to FIG. 2, it can be seen that the underside of the base means 11 include an anchoring means comprising a plurality of disks 20, 21, 22 and 23 which are further embedded into the ground 12 beneath the device so that any rotation or movement of the device is retarded. Other types of anchoring means may be employed such as spikes, nails or the like. In this latter instance, such spikes or nails may be projected through apertures or openings such as openings 24 and 25 in the bottom of the base means 11. The anchor means represented by the disks 20–23 inclusive may also take the form of anti-skid disks which would prevent moving of the device on cement or pavement surfaces in the event the pad 10 was to be used for that purpose.

Figure 3:
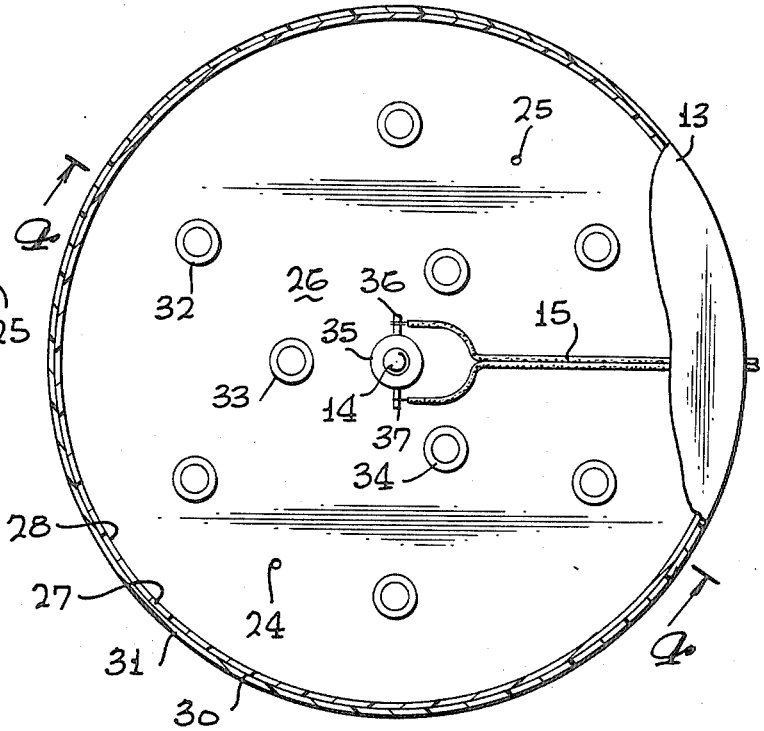
FIG. 3 is an enlarged plan view of the stepping stone or foot pad shown in FIG. 1A having a portion of the lid removed to expose load bearing means and illuminating means.

Referring now in detail to FIG. 3, it can be seen that the base means 11 includes a panel 26 onto which a continuous, upright sidewall 27 is provided which includes a terminating upper lip 28 having an outer surface which is knurled as represented by numeral 30. The lid 13 includes a downwardly depending flange 31 which resides on the outside of the lip 27 and bears against the irregular surface 30 so as to be retained thereon. However, the lid may be removed for maintenance and service purposes if required. Holes or openings 24 and 25 are in the panel 26 through which anchoring spikes may be placed if needed. Also, load bearing means are provided between the opposing surfaces of the base 26 and the underside of lid 13 which comprise a plurality of cylindrical standoffs such as represented by numerals 32, 33 and 34. The stand-offs, such as stand-off 32, are placed in a circle about the bulb 14 while the stand-offs represented by numerals 33 and 34 are placed between the circular row of stand-off 32 and the bulb 14. Therefore, this arrangement provides adequate load bearing and oad transferring means so that the weight of a person stepping on lid 13 will be carried through the stand-offs and the upright sidewall 27 into the supporting ground or other support means. The bulb 14 is removably carried in a socket 35 and electrical lead 15 is coupled to the socket and bulb respectively by means of connectors 36 and 37.

Figure 4:
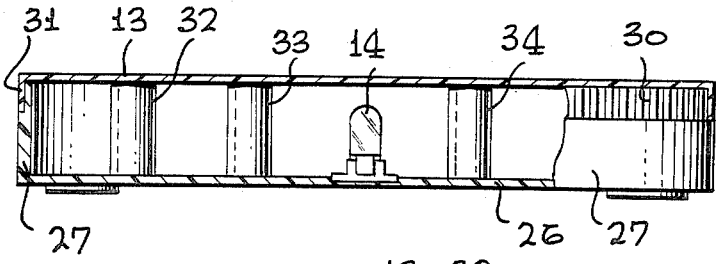
FIG. 4 is a transverse cross-sectional of the stepping stone or foot pad taken in the direction of arrows 4—4 of FIG. 3.
Figure 7:
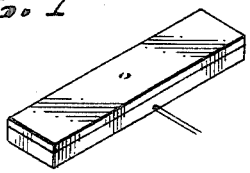
FIG. 7 is a perspective view of another embodiment of the invention illustrating the stepping stone or foot pad as being of an elongated shape or configuration.

Referring now in detail to FIG. 4, it can be seen that the stand-offs bear at their opposite ends against the panel 26 and the underside of the lid 13 respectively. Also, it can be seen that the downwardly depending flange 31 of the lid overlaps the edge marginal region of the terminating end of the base sidewall 27.

Figure 5:
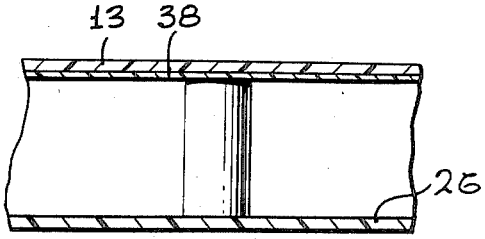
FIG. 5 is an enlarged view of a cross-section of the foot pad shown in FIG. 1C as taken in the direction of arrows 5—5 thereof.

Referring now in detail to FIG. 5, it can be seen that the graphic subject matter 17 may be carried on an individual thin disk or mat indicated by the numeral 38 which lies beneath the lid 13. The terminating end of the stand-off bears thereagainst to assure load carrying and transferring capabilities. However, it is to be understood that the disk 38 is of translucent or transparent material and that the message or graphic subject matter carried thereon is readily illuminated by the bulb 14 and that such a message or graphic material is visible through the translucent or transparent material composed of lid 13.

Figure 6:
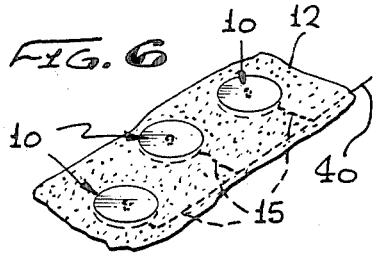
FIG. 6 is a reduced perspective view showing a typical arrangement of foot pads incorporating the present invention and a common electrical voltage source therefor.

Referring now in detail to FIG. 6, a typical pattern of stepping stones or foot pads is illustrated to mark a pathway wherein a plurality of devices 10 of the present invention are embedded into the ground 12. The leads 15 are suitably connected to a common cable 40 which is attached to a low voltage source at a remote location. It can be seen that the base means are embedded into the ground 12 and that only the exterior surface of the lid 13 is exposed for message presentation and to be stepped on by a user. No alternate lighting system is required for marking the pathway or the stepping stones and the message display or graphic characters may be readily changed from time to time if desired.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A luminous stepping or foot pad for marking a footpath comprising:

a base means composed of translucent or transparent material having a flat, circular panel engaging a ground surface which supports a continuous upright sidewall terminating in a knurled lip;

a lid or cover having a downwardly depending knurled flange detachably connected to said knurled lip of said base means continuous upright sidewall said lid or cover and said circular panel having opposing surfaces spaced apart by said sidewall defining a central cavity;

low voltage electrical illumination means strategically located on said circular panel of said base means for projecting light throughout said central cavity;

said lid or cover composed or translucent or transparent material transmitting light therethrough from said central cavity;

load-bearing supports disposed between said lid or cover and said circular panel opposing surfaces for transferring applied loads therebetween comprising a plurality of columns having their opposite ends in load-bearing engagement with said opposing surfaces of said lid or cover and said circular panel;

an irregular surface of non-skid material carried on the exposed exterior surface of said lid or cover;

a decorative display means disposed on selected portions of said lid irregular surface comprising indicia or graphic subject matter visible when said central cavity is illuminated;

anchor means carried on said circular panel for retaining said base means in position on said ground surface.

* * * * *